US005154624A

United States Patent [19]

Lemajeur et al.

[11] Patent Number: 5,154,624

[45] Date of Patent: Oct. 13, 1992

[54] IGNITION COIL ADAPTER FOR A DISTRIBUTORLESS IGNITION SYSTEM

[75] Inventors: Scott W. Lemajeur, Niles; John H. Wessel, St. Charles, both of Ill.

[73] Assignee: Cooper Industries, Inc., Houston, Tex.

[21] Appl. No.: 759,388

[22] Filed: Sep. 13, 1991

[51] Int. Cl.[5] ..... H01R 13/44

[52] U.S. Cl. ..... 439/130; 123/143 C

[58] Field of Search ..... 439/125-130; 123/143 C, 634, 635

[56] References Cited

U.S. PATENT DOCUMENTS

| | | | |
|---|---|---|---|
| 2,904,769 | 9/1959 | Sampson et al. | 439/125 |
| 4,743,211 | 5/1988 | Hirata et al. | 123/169 PH X |
| 4,790,767 | 12/1988 | Sturdevan et al. | 439/125 |

OTHER PUBLICATIONS

Carcraft Magazine, p. 64, Mar. 1992.
MSD Catalog, 1988, p. 51.
Photocopy of MSD Part No. 8805 Package.
Sample of MSD Part No. 8805.

*Primary Examiner*—Eugene F. Desmond
*Attorney, Agent, or Firm*—Eddie E. Scott; William B. Patterson; Alan R. Thiele

[57] ABSTRACT

An adapter providing electrical and water-tight mechanical connection between a spark plug cable and a high output terminal of a distributorless ignition system. An expandable, electrode extension is anchored in the ignition system terminal at one end and connected to the spark plug cable via a spark plug terminal at the opposite end. The extension fits within a rubber insert that is inserted into the ignition tower to provide a water tight seal.

19 Claims, 2 Drawing Sheets

FIG. 1
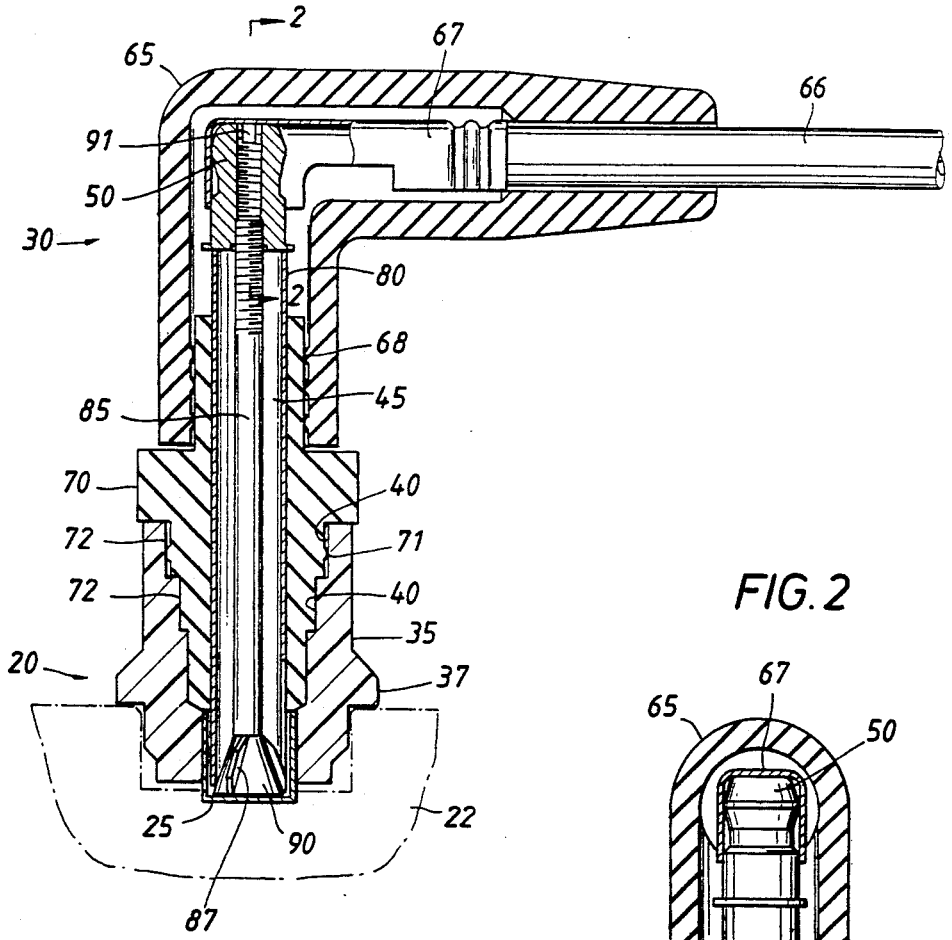
FIG. 2
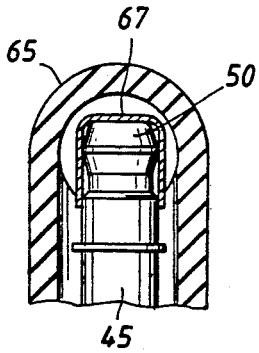
FIG. 3
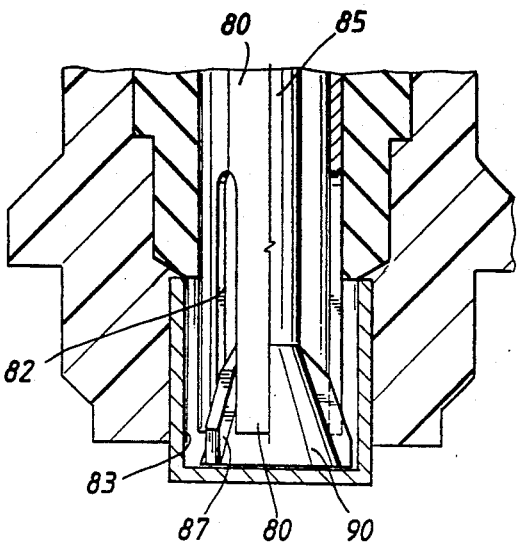
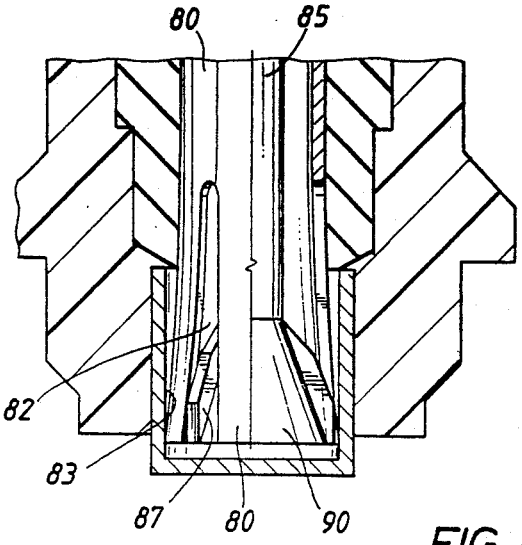
FIG. 4

IGNITION COIL ADAPTER FOR A DISTRIBUTORLESS IGNITION SYSTEM

BACKGROUND OF THE INVENTION

The present invention relates to electrical adapters for distributorless ignition systems; more particularly, the present invention relates to an adapter for use between a spark plug cable and a high output terminal of a distributorless ignition system.

Prior art automotive ignition systems relied upon a distributor to deliver energy to spark plugs at given intervals. In a distributorless ignition system, the timing function is computerized and each spark plug is attached to a separate high energy output terminal which delivers energy at the proper interval, eliminating the need for a distributor.

Typically, the distributorless ignition system (D.I.S.) includes multiple terminals, each of which include a cup-shaped electrode and a tower extending upward from the electrode. The spark plug cable must be connected to the high output terminal to deliver energy to the spark plug located at the opposite end of the spark plug cable. The connection means between the cable and the terminal must provide an electrical as well as a water-tight mechanical connection. Prior art adapters designed for connecting the spark plug cable to the high output terminal of a D.I.S. include the device disclosed in U.S. Pat. No. 4,790,767 to Sturdevan. The device described in this patent is a cap-like arrangement with an annular recess that fits over the top of the tower to effect a water-tight seal. Mechanical connection is made with levered dogs which grip a flange formed at the outside of the tower. Electrical connection in the device described in U.S. Pat. No. 4,790,767 is by a terminal which fits within the cupshaped electrode of the D.I.S.

One disadvantage of the adapter disclosed in U.S. Pat. No. 4,790,767 is its reliance on the external shape of the tower for a proper connection and water-tight seal. While present distributorless systems like those utilized by Ford Motor Company include a flanged tower, future D.I.S. designs may not have flanged towers and may require internal connections and sealing. Additionally, as space becomes more important in automotive designing, future distributorless systems may require the output terminals to be spaced closer together making it impracticable to use an adapter which grips the outside of the tower.

There is a need, therefore, for an adapter for a distributorless ignition system which does not utilize the outside perimeter of the tower for mechanical connection or water-tight sealing.

There is a further need, therefore, for an adapter for a distributorless ignition system which requires less space than those presently available.

SUMMARY OF THE INVENTION

The present invention is an adapter which provides a watertight, mechanical and electrical connection between a spark plug cable and the high energy output terminal of distributorless ignition systems. It does not utilize the outside perimeter of the tower and it requires less space than those adapters presently available. The ignition system includes a cup-shaped electrode and a tower extending upward from the electrode. The adapter includes an electrode extension which expands into the cup-shaped electrode at one end and is connected to the spark plug cable at the opposite end. The extension is held within a rubber insert which is pressfit into the tower at one end and a boot at the opposite end, providing an internal water-tight seal within the adapter.

BRIEF DESCRIPTION OF THE FIGURES

FIG. 1 is a side view, in section of the adapter that is the subject of the present invention;

FIG. 2 is a section view depicting the terminal connection between the spark plug cable and the cap;

FIG. 3 is a detailed view depicting the expanding means in a non-energized position;

FIG. 4 is a detailed view depicting the expanding means in an energized position;

DESCRIPTION OF A PREFERRED EMBODIMENT

Figure 6:
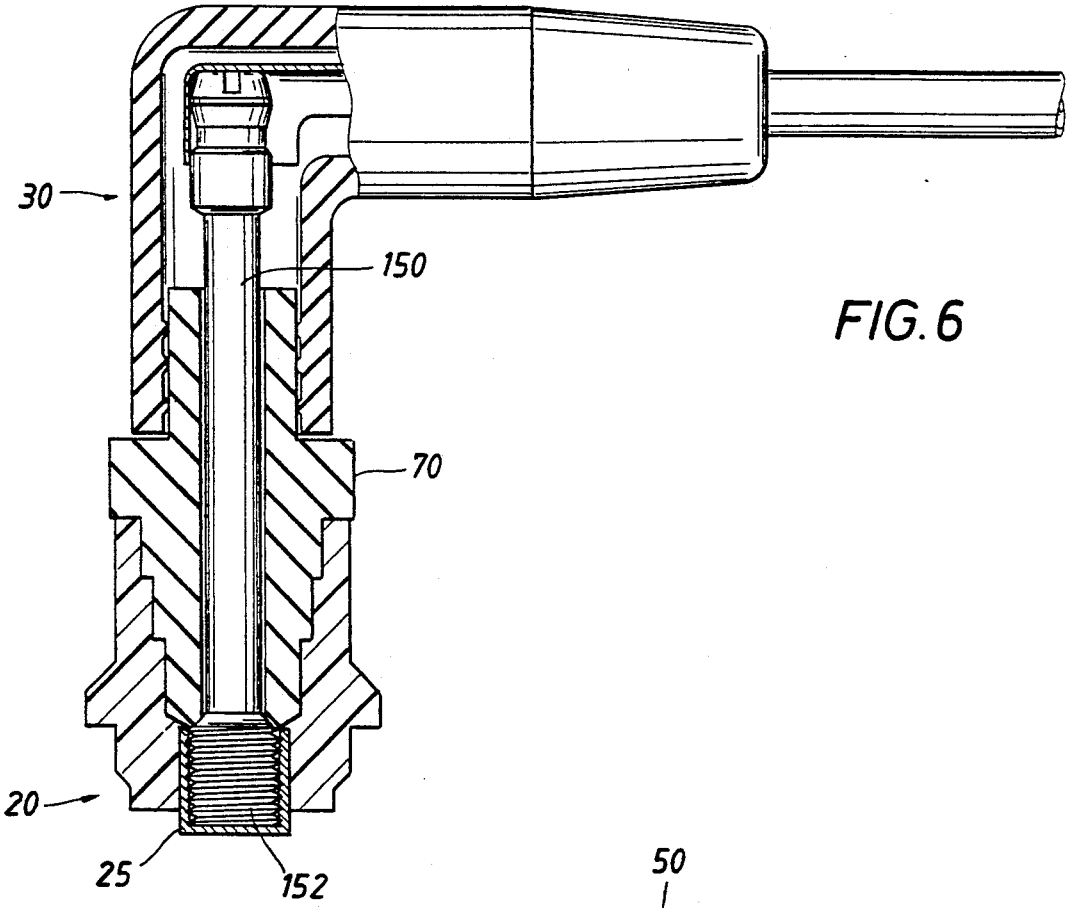
FIG. 6 is a section view showing a third embodiment of the invention.

The present invention can best be appreciated by reference to the Figures. FIG. 1 is view in section of a high voltage output terminal 20 of a distributorless ignition system with the adapter 30 of the present invention. The output terminal 20 is exemplary of the current D.I.S. utilized by the Ford Motor Company and consists of a cup-shaped electrode 25 and a dielectric tower 35 which extends up from the electrode 25. The tower 35 and electrode 25 are component parts of module 22. Also included in the module 22 is a coil (not shown) for each electrode or pair of electrodes. In a typical system, at least one module containing several towers, electrodes and coils will be located in the engine compartment of the automobile. Tower 35 acts to provide an entrance to the electrode 25 with a series of increasingly smaller inside diameters 40. The exterior of tower 35 includes a circular flange 37.

Electrical connection between the cup-shaped electrode 25 and the spark plug cable 66 is through an electrode extension 45 which acts to extend the cup-shaped electrode 25. The electrode extension 45 is made of an electrically conductive material and is anchored at the bottom of electrode 25 by expanding means. In the preferred embodiment the extension 45 includes a cylindrical body 80 having slots 82 (FIGS. 3 and 4) extending upward from its bottom end. Extension 45 also has a threaded shaft 85 running its length. At the bottom end, the shaft 85 forms a cone-shaped head 90. The larger diameter of the cone-shaped head 90 extends partially from the end of extension body 80. At the upper end of threaded shaft 85 is a cap 50 which is slotted at 91 to allow the cap 50 to be turned with a screwdriver.

The cylindrical body 80 is held in compression between the cap 50 and the cone-shaped head 90 of shaft 85. As ca 50 is turned in a clockwise motion on threaded shaft 85, tabs 87 on the sides of cone-shaped head 90 contact slots 82 and prevent the rotation of shaft 85. FIG. 3 depicts the expanding means of the extension 45 in the non-energized position. As shown in FIG. 3, the tabs 87 on cone 90 have slipped into slots 82, but the bottom of cone 90 still extends from extension body 80.

FIG. 4 depicts the expansion means in the energized, anchored position. As the cap 50 is rotated clockwise, cone-shaped head 90 is pulled into the end of body 80, spreading body 80 along slots 82. By forcing body 80 into the inside walls 83 of cupshaped electrode 25, the extension 45 is anchored within electrode 25.

Cap 50 could be fitted with a means for locking the extension 45 in the energized position. For example, a lock washer could be utilized between cap 50 and the top surface of body 80, preventing shaft 85 from moving once cone-shaped head 90 has been pulled into body 80. Additionally, locking ears could be formed on the bottom surface of cap 50 or the top surface of body 80 to lock the cap 50 in place after energizing. Additions of the foregoing sort are contemplated as an aspect of the invention.

Water-proofing is accomplished by an elastomer insert 70 which is designed to fit around and support the electrode extension 45 in a coaxial relationship. The outer, bottom portion of insert 70 forms progressively smaller diameters 72 which are slightly larger than inside diameters 40 of tower 35, allowing a press-fit between insert 70 and tower 35. In the preferred embodiment, there is a sealing ridge 71 (FIG. 1) formed in the largest diameter of insert 70 to further effect a water-tight seal. At its upper end, insert 70 fits into elastomer boot 65. The upper portion of insert 70 is slightly greater in diameter than the inside diameter of boot 65, allowing a press-fit between the insert 70 and boot 65. In the preferred embodiment, the inside diameter of boot 65 includes a series of ridges 68 which ar designed to further seal the boot 65 and insert 70 surfaces.

The adapter can be supplied with a spark plug cable 66 with an attached terminal 67 and boot 65. The electrode extension 45 is 15 supplied already inserted into the insert 70. The extension and insert assembly is then placed in the high output terminal 20 of the D.I.S. with the insert 70 sealing the tower 35 and the coneshaped head 90 extending into the cup-shaped electrode 25. The cap 50 at the top of extension 45 is then turned forcing the coneshaped head 90 into body 80, thereby expanding the body 80 and anchoring extension 45. Thereafter, the boot 65 containing the spark plug cable 66 and terminal 67 are placed over cap 50, making an electrical and mechanical connection between ca 50 and spark plug terminal 67 (FIG. 2). A water-tight seal is simultaneously made between the surfaces of the insert 70 and boot 65 (FIG. 1).

Figure 5:
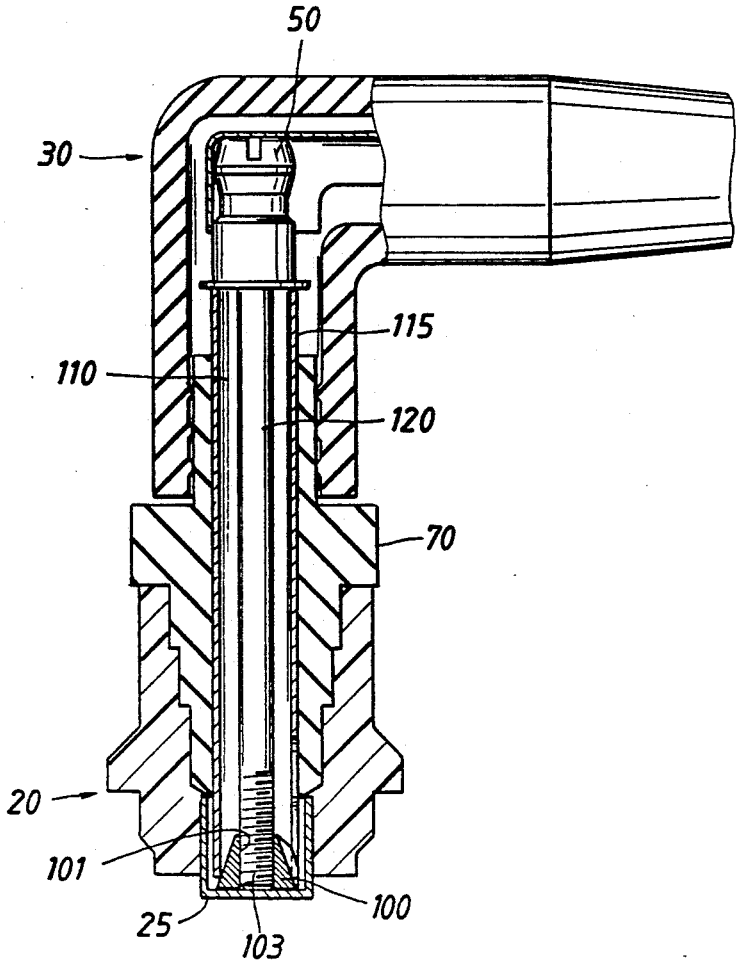
FIG. 5 is a section view showing a second embodiment of the invention.

One variation of the preferred embodiment, depicted in FIG. 5, includes a separate cone-shaped member 100 which has internal threads 101. As in the first embodiment, the extension 110 has a body 115 with slots (not shown) in the lower end and a center shaft 120. However, the bottom portion 103 of the shaft 120 is threaded. To utilize the adapter, cone 100 is first placed into the cupshaped electrode 25 in a press-fit relation. Thereafter, the shaft 120 is threaded into the cone 100, pulling it into the body 115 of the extension 110 and expanding the body 115 into the walls of cupshaped electrode 25. While the electrode extension 4 and anchoring means 90 described and depicted is the preferred embodiment, one skilled in the art will appreciate that the method of anchoring the electrode extension 45 to the cup-shaped electrode 25 could vary and still be within the scope of the invention. For example, as depicted in FIG. 6, the extension body 150 could be solid with a threaded bottom portion 152 having an outside diameter slightly larger than the inside diameter of cup-shaped electrode 25. The extension 150 could then be threaded into electrode, forming threads within the interior of the electrode cup 25.

In yet another alternative embodiment (not shown) the electrode extension consists of three pieces of metal giving the appearance of a round rod with a threaded cap on one end. The rodlike assembly includes a center section and two outer sections. The end of the center section opposite the threaded cap is tapered to reduce the cross-section at that end. The two outer sections have a matching but reverse taper. The ends of the outer sections opposite the taper are threaded to accept a portion of the threaded cap. The center section is longer than the outer sections, has no threads and has a shaft-like extension which fits into the threaded cap allowing the cap to rotate. When first assembled the threepiece assembly has essentially the same diameter throughout its length which allows it to be inserted in a hole of slightly larger diameter. When the cap is turned, the two outer sections move up or down along the center section, depending on the direction the cap is turned and whether right-hand or left-hand threads are used. When the cap is turned to cause the outer sections to move into the threaded cap, the tapers cause the outer sections at the opposite end to move outward, increasing the diameter of the unthreaded end of the assembly thereby anchoring the assembly against the walls of the cup-shaped electrode 25.

In the forgoing embodiments, the cap 50 is provided with a slot 91 for a regular screwdriver. However, one skilled in the art will realize that the cap 50 could be shaped for use with any type of screw driver or wrench and still be in the purview of the invention. Additionally, the threads could be left or righthanded, requiring rotation in either direction to anchor the extension within the cup-shaped electrode.

At its upper end, extension 45 is electrically and mechanically connected to spark plug cable 60. In the preferred embodiment, as depicted in FIG. 2, the extension 45 is connected to the cable by a standard female spark plug terminal which fits over cap 50. However, the connection could be made any number of ways. For example, the top of the extension 45 could form a female member and the terminal could be a male member. Also, while the elastomer boot 65 is shown in the preferred embodiment as forming a 90 degree angle, those skilled in the art will appreciate that the boot 65 could form any angle or even be straight and still preform the same function and be within the scope of the invention.

While the adapter of the present invention has been described by reference to its preferred embodiment, it will be understood that other various embodiments of the device and method of the present invention may be possible by reference to the specification and the appended claims. Such additional embodiments shall be included within the scope of the appended claims.

I claim:

1. An adapter for connecting an electrical terminal of a spark plug cable to a high voltage output terminal of a distributorless ignition system having a cup-shaped electrode and dielectric tower, said adapter comprising:

an electrode extension providing electrical connection between said cup-shaped electrode and said spark plug cable, said extension having a substantially cylindrical body with first and second ends;

said first end of said extension constructed and arranged to fit within said cup-shaped electrode and having means for mechanical connection to said electrode;

said second end of said extension having means for mechanical connection to said spark plug cable;

a boot member, said boot member having first and second ends;

said first end of said boot member annularly disposed around said spark plug cable; and an insert member, said insert member coaxially disposed around said body of said extension;

a first end of said insert member disposed in water-tight relation within said tower, a second end of said insert disposed in water-tight relation within said second end of said boot.

2. The adapter described in claim 1, whereby;

said means for mechanical connection between said extension and said cup-shaped electrode is an expanding member, said expanding member including:

a threaded shaft extending the length of said body, said threaded shaft having a first end terminating in a cone, said cone having a small and large end, said large end of said cone in frictional relation to said body and extending outside said body and having a diameter slightly greater than the inside diameter of said body;

an internally threaded retaining cap, said retaining cap constructed and arranged to house said second end of said shaft at said second end of said extension body;

a plurality of longitudinal slots in the first end of said extension body;

whereby, as said cap is rotated, said shaft moves axially towards said cap and said large end of said cone is pulled into said first end of said body, thus causing said first end of said body to separate along said longitudinal slots and contact said inside walls of said cup-shaped electrode, thereby providing mechanical connection between said body and said electrode.

3. The adapter described in claim 2, whereby said cap includes a slot for insertion of a screwdriver thereby allowing said cap to be rotated in a circular motion.

4. The adapter described in claim 3, whereby said large end of said cone includes a plurality of tabs located around the perimeter of said large end of said cone, said tabs constructed and arranged to contact said slots in said body, thereby preventing rotation of said threaded shaft as said cap is rotated.

5. The adapter described in claim 4, whereby said means for electrical connection of said second end of said extension to s id spark plug cable is a terminal, said terminal having a first and second ends, said first end attached to said spark plug cable and said second end constructed and arranged to fit over said cap.

6. The adapter described in claim 5, whereby said first end of said insert includes a plurality of decreasing diameters, said diameters slightly, larger than increasing inside diameters with said tower whereby said insert is held in said tower in a frictional relationship, thereby preventing moisture between said insert and said tower.

7. The adapter described in claim 6, whereby one or more of said decreasing diameters at said first end of said insert includes at least one sealing ridge, said sealing ridge extending around the perimeter thereof.

8. The adapter described in claim 7, whereby said second end of said boot includes a plurality of ridges around the interior thereof, said ridges forming inside diameters, said inside diameters slightly smaller than the outside diameter of said second end of said insert, giving said boot and insert a watertight, frictional relationship.

9. The adapter described in claim 1, whereby said means for mechanical connection between said extension and said cup-shaped electrode includes external threads at the first end of said extension, said threaded first end of said extension having an outside diameter slightly greater than the inside diameter of said cup-shaped electrode, whereby as said extension is rotated in said cup-shaped electrode, said threaded first end of said shaft engages said cup-shaped electrode, anchoring said shaft in said electrode.

10. The adapter described in claim 1, whereby said means for mechanical connection between said extension and said cup-shaped electrode includes:

a cone, frictionally insertable into said cup-shaped electrode whereby the larger end of said cone is adjacent to the bottom of said electrode, said cone having a threaded aperture in the smaller end;

a threaded shaft coaxially housed within said extension body, said shaft constructed and arranged to be threaded into said aperture in said small end of said cone;

whereby, as said shaft is rotated, said cone is pulled into said body, expanding said body into said walls said cup-shaped electrode, thereby anchoring said extension in said electrode.

11. A device for transmitting electrical energy from a distributorless ignition system having a cup-shaped electrode and dielectric tower to a spark plug, said device comprising:

a length of electrical cable;

means for electrically and mechanically connecting said cable to said spark plug;

an electrode extension providing electrical connection between said cup-shaped electrode and said spark plug cable, said extension having a substantially cylindrical body with first and second ends;

said first end of said extension constructed and arranged to fit within said cup-shaped electrode and having means for mechanical connection to said electrode;

said second end of said extension having means for mechanical connection to said spark plug cable;

a boot member, said boot member having first and second ends;

said first end of said boot member annularly disposed around said spark plug cable; and an insert member, said insert member coaxially disposed around said body of said extension;

a first end of said insert member disposed in water-tight relation within said tower, a second end of said insert disposed in water-tight relation within said second end of said boot.

12. The device described in claim 11, whereby:

said means for mechanical connection between said extension and said cup-shaped electrode is an expanding member, said expanding member including:

a threaded shaft extending the length of said body, said threaded shaft having a first end terminating in a cone, said cone having a small and large end, said large end of said cone in frictional relation to said body and extending outside said body and having a diameter slightly greater than the inside diameter of said body;

an internally threaded retaining cap, said retaining cap constructed and arranged to house said second end of said shaft at said second end of said extension body;

a plurality of longitudinal slots in the first end of said extension body;

whereby, as said cap is rotated, said shaft moves axially towards said cap and said large end of said cone is pulled into said first end of said body, thus causing said first end of said body to separate along said longitudinal slots and contact said inside walls of said cup-shaped electrode, thereby providing mechanical connection between said body and said electrode.

13. The device described in claim 12, whereby said cap includes a slot for insertion of a screwdriver thereby allowing said cap to be rotated in a circular motion.

14. The device described in claim 13, whereby said large end of said cone includes a plurality of tabs located around the perimeter of said large end of said cone, said tabs constructed and arranged to contact said slots in said body, thereby preventing rotation of said threaded shaft as said cap is rotated.

15. The device described in claim 14, whereby said means for electrical connection of said second end of said extension to said spark plug cable is a terminal, said terminal having a first and second ends, said first end attached to said spark plug cable and said second end constructed and arranged to fit over said cap.

16. The device described in claim 15, whereby said first end of said insert includes a plurality of decreasing diameters, said diameters slightly larger than increasing inside diameters within said tower whereby said insert is held in said tower in a frictional relationship, thereby preventing moisture between said insert and said tower.

17. The adapter described in claim 16, whereby one or more of said decreasing diameters at said first end of said insert includes at least one sealing ridge, said sealing ridge extending around the perimeter thereof.

18. The device described in claim 17, whereby said second end of said boot includes a plurality of ridges around the interior thereof, said ridges forming inside diameters, said inside diameters slightly smaller than the outside diameter of said second end of said insert, giving said boot and insert a watertight, frictional relationship.

19. A method of connecting a boot having a spark plug cable and spark plug terminal to the high energy output terminal of a distributorless ignition system having a cup-shaped electrode and a tower, said method comprising the steps of:

inserting an insert and an extension into said output terminal of said distributorless ignition system, whereby said insert seals said tower and said extension extends into said cupshaped electrode;

rotating said extension until said extension is anchored in said cup-shaped electrode;

attaching said boot, to the top of said extension whereby an electrical connection is maintained between said cup-shaped electrode and said spark plug cable and a water-tight relationship exists between said boot and said insert.

* * * * *